US006991717B2

(12) United States Patent
King et al.

(10) Patent No.: US 6,991,717 B2
(45) Date of Patent: Jan. 31, 2006

(54) WEB PROCESSING METHOD AND APPARATUS

(75) Inventors: Gregory F. King, Minneapolis, MN (US); John S. Huizinga, Dellwood, MN (US); James N. Dobbs, Woodbury, MN (US); Luther E. Erickson, Grant, MN (US); Daniel H. Carlson, Arden Hills, MN (US); Dale L. Ehnes, Rohnert Park, CA (US); Gary A. Shreve, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 388 days.

(21) Appl. No.: 10/116,822

(22) Filed: Apr. 5, 2002

(65) Prior Publication Data

US 2003/0188965 A1 Oct. 9, 2003

(51) Int. Cl.
*C25D 5/02* (2006.01)
*C25D 17/00* (2006.01)

(52) U.S. Cl. ..... 205/118; 205/120; 205/129; 205/133; 204/202; 204/206; 204/224 R; 204/237; 204/275.1; 118/32; 118/400; 118/404; 118/405; 118/406; 118/419; 118/423; 118/428; 427/209; 427/210; 427/256; 427/282; 427/430.1; 427/434.2; 427/443.1

(58) Field of Classification Search ..... 204/202, 204/206, 224 R, 237, 275.1; 205/118, 120, 205/129, 133, 138; 118/32, 400, 404–406, 118/419, 423, 428; 427/209, 210, 256, 282, 427/430.1, 434.2, 443.1

See application file for complete search history.

(56) References Cited

U.S. PATENT DOCUMENTS

| | | | | |
|---|---|---|---|---|
| 2,035,517 A | | 3/1936 | Yates | |
| 2,142,512 A | | 1/1939 | Hartel | |
| 2,930,739 A | | 3/1960 | Burnham | |
| 2,993,848 A | * | 7/1961 | Brennan | 205/139 |
| 3,156,396 A | | 11/1964 | Snyder et al. | |
| 3,156,399 A | | 11/1964 | Wadey | |
| 3,197,339 A | | 7/1965 | Black et al. | |
| 3,267,017 A | | 8/1966 | Greene et al. | |
| 3,498,515 A | | 3/1970 | Johnson | |
| 3,567,093 A | | 3/1971 | Johnson | |
| 3,599,851 A | | 8/1971 | Hedlund et al. | |
| 3,644,181 A | * | 2/1972 | Donaldson | 205/118 |
| 3,741,650 A | | 6/1973 | Leavitt et al. | |

(Continued)

FOREIGN PATENT DOCUMENTS

EP 0 578 040 1/1994

(Continued)

OTHER PUBLICATIONS

*Research Disclosure*, Mar. 1989, "Photographic Film Processor Rack and Tank Assembly", pp. 170-171, Disclosed Anonymously.

*Primary Examiner*—Arun S. Phasge
(74) *Attorney, Agent, or Firm*—Rick L. Franzen; Brian E. Szymanski

(57) ABSTRACT

The present invention relates to a web handling apparatus and process ideally suited for applications involving wet chemistry. The invention involves the horizontal processing of webs in processing containers. The web is redirected into the processing container by inserting a cassette across the web and into the processing container. The cassette includes at least one functional fluid element that facilitates processing of the web. The web handling practices of the invention improve the quality of the processed web. The invention is preferably used in electrodeposition processes.

54 Claims, 5 Drawing Sheets

U.S. PATENT DOCUMENTS 3,819,502 A * 6/1974 Meuldijk et al. ..... 204/206
4,132,609 A 1/1979 Bush et al.
4,138,047 A 2/1979 Sherman
4,182,472 A 1/1980 Peekna
4,248,516 A * 2/1981 Grooters ..... 396/620
4,310,403 A 1/1982 Nitto et al.
4,322,026 A 3/1982 Young, Jr.
4,495,024 A 1/1985 Bok
4,507,190 A 3/1985 Brendlinger et al.
4,796,041 A 1/1989 Ishikawa et al.
4,910,546 A 3/1990 Nonaka et al.
4,945,375 A 7/1990 Nakamura et al.
5,289,639 A 3/1994 Bard et al.
5,311,235 A 5/1994 Piccinino, Jr. et al.
5,338,413 A * 8/1994 van Dijk et al. ..... 205/77
5,353,979 A 10/1994 Gartmann
5,395,508 A * 3/1995 Jolly et al. ..... 205/129
5,418,073 A * 5/1995 Loth et al. ..... 428/625
5,525,751 A * 6/1996 Niederkorn ..... 118/423
5,804,053 A 9/1998 Vaccaro et al.
5,942,096 A 8/1999 Ruzicka et al.

FOREIGN PATENT DOCUMENTS

ES 2 029 422 8/1992
JP 62 083492 A 4/1987
JP HEI 11-223913 8/1999

* cited by examiner

WEB PROCESSING METHOD AND APPARATUS

TECHNICAL FIELD

The present invention relates to a web handling apparatus and process ideally suited for applications involving wet chemistry, more particularly the invention involves the horizontal processing of webs utilizing unique handling practices that improve the quality of the processed web.

BACKGROUND OF THE INVENTION

Products are often manufactured in a continuous web format for economic reasons and to obtain processing efficiencies. When it is desirable to treat these webs with wet chemistries, i.e. for methods such as plating or coating, the web material often passes through a liquid processing tank. Continuous web processing with wet chemistry can create material handling issues as well as finished product quality issues.

A conventionally practiced electrodeposition method for continuous webs is generally shown in FIG. 1. The method includes holding a web 10 in a vertical orientation and passing it through slots 12 located on opposing ends of a liquid processing tank 14. The web 10 travels in direction 16. Idler or contact rolls 18 provide an electrical charge to the web 10. Liquid processing tank 14 contains a process solution 19 containing a component to be deposited on the web 10. Anode screens, not shown, inside the liquid processing tank 14 complete an electrical circuit causing the desired component in the process solution 19 to be deposited on the web 10. The size of the liquid processing tank 14 and the speed of the web through the liquid processing tank 14 are generally designed to achieve the desired residence time necessary to complete the processing of the web 10. However, the established length of the liquid processing tank 14 severely limits the ability to adjust residence time for different web applications through the same system, especially in a multi-step process where the ratio of residence times cannot be adjusted independently. Additionally, since it is desired that the slots 12 be wider than the thickness of the web 10, some amount of the process solution 19 escapes the liquid processing tank 14 through the slots 12 requiring a capture system. This flow of process solution 19 from the liquid processing tank 14 may cause aeration of the process solution 19 which can adversely affect the electrodeposition process and the quality of the finished web 10. Additionally, weir flows lead to situations where the residence times between the upper portion and lower portion of the web can vary resulting in cross web uniformity differences.

Web handling processes similar to the one described in FIG. 1 are often used to apply coating to delicate webs. Delicate webs are generally considered webs that are fragile either due to the thinness of the substrate or due to a lack of structural integrity caused by holes or other discontinuities in the web. Additionally, wet chemistry processing can create situations where conventional webs become fragile and thus should be treated in the same manner as delicate webs. For delicate webs, the tensions on the free span of the web may cause the material to bow or form wrinkles. In the case of electrodeposition, this will cause a non-uniform distance between the web and the anode screen resulting in poor uniformity of the deposition thickness. These wrinkles may also introduce varying stresses into the web which may exceed the critical yield stress of the web.

Horizontal processing of webs generally requires threading the web around rollers in an open top cavity liquid processing tank. The liquid processing tank is then filled with the process solution. The rollers may introduce damage, such as stretching, tears, or scratches, to the web as it is dragged over the rollers.

It would be desirable to process webs more efficiently without adversely affecting the quality of the web. It would also be desirable to process a web in a horizontal manner without concern for damage to the web caused by contact or drag over rollers. When the web of interest is delicate either due to the thinness of the substrate or a lack of structural integrity caused by holes or other discontinuities, it would be desirable to process the web at low tension to minimize residual stress in the finished web.

SUMMARY OF THE INVENTION

The present invention is directed to a method and apparatus for processing webs of sheet-like material. The apparatus of the invention includes a substantially horizontal web path for directing a web of sheet-like material. Also included in the apparatus is at least one processing container and at least one cassette. The cassette has at least one functional fluid element affixed to it. The cassette is generally movable and, upon insertion of the cassette across the web and into the processing container, redirects the web into the processing container. The cassette includes at least one functional fluid element that facilitates processing of the web.

The apparatus is utilized to practice a method comprising inserting at least one cassette having at least one functional fluid element across a substantially horizontal web to introduce the web into a processing container. The insertion of the cassette across the web forms a festoon, or a directional displacement of the web in a processing zone in the processing container. The cassette and the processing container may be designed with varying dimensions in order to achieve a desired residence time for the web in the processing zone. Once the festoon is created by insertion of the cassette, processing of the web may begin while the web is conveyed through the processing container.

The method and apparatus of the present invention are ideally suited for web processing practices that would benefit from reduced tension on the web. Preferably, the present invention may be utilized for various web processing practices such as, for example, electroless plating, electrodeposition, delaminating, stripping, swelling, developing, saturating, washing, cleaning, rinsing, etching, chemical milling, coating, solvent deposition, fuming, sparging or combinations of the noted practices. Additionally, multiple embodiments of the present invention may be placed in series to enable multiple step processes.

The horizontal alignment of the web and the use of functional fluid elements enable processing conditions that result in improved finished web characteristics. For example, the present invention exhibits a relatively flat web with a significantly reduced tension on the web during processing. The improvement of web characteristic during processing result in enhanced properties of the finished web. This is particularly true for coating or plating operations where tension on the web during application of a coating can adversely affect the finished web by imparting defects such as a permanent curvature.

For purposes of the present invention, the following terms used in this application are defined as follows:

"festoon" means a directional displacement of a web in a specified process zone to increase residence time in the process zone;

"web" means a sheet of material having a dimensional width in one direction and indeterminate length in the orthogonal direction;

"substantially horizontal web path" means a path in which the width of the web is essentially traveling parallel to the ground while entering the processing container, during processing in the processing container and upon exiting the processing container;

"electroless plating" means chemical deposition without the use of applied electrical fields; and "electrodeposition" is intended to cover both electrophoretic deposition as well as electroplating.

BRIEF DESCRIPTION OF THE DRAWINGS

The above, as well as other advantages of the present invention will become readily apparent to those skilled in the art from the following detailed description when considered in the light of the accompanying drawings in which.

While the above-identified drawing figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

Figure 2:
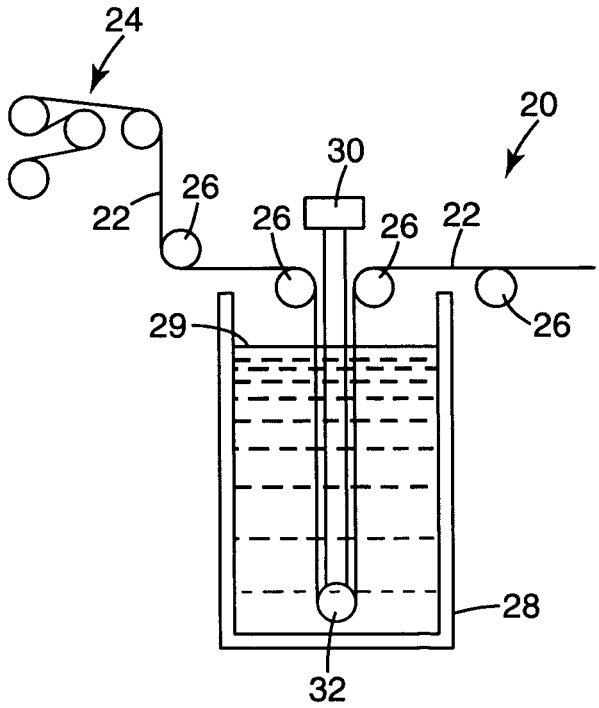
FIG. 2 is a schematic view of an apparatus for practicing the method of the present invention.

An embodiment of the method and apparatus of the present invention is depicted in FIG. 2. The apparatus 20 includes a web 22 traveling in a substantially horizontal web path. The web is optionally conveyed through a steering unit 24 and over a plurality of rollers 26. The web path is generally directed over a processing container 28 which contains an amount of processing fluid 29. The web 22 essentially travels over, and subsequently past, the processing container 28. The web 22 is redirected into the processing container 28 upon insertion of a moveable cassette 30 across the web 22 and into the processing container 28. The insertion of the cassette creates a festoon, or a directional displacement of the web 22 into a processing zone within the processing container 28. The cassette 30 includes at least one functional fluid element 32 that is generally utilized for processing the web 10 in a desired manner.

The method of the present invention is suitable for use with various types of web processing techniques. Non-limiting examples of potential applications for the invention include electroless plating, electrodeposition, delaminating, stripping, swelling, developing, saturating, washing, cleaning, rinsing, etching, chemical milling, coating, solvent deposition, fuming, or sparging. Preferably, two or more embodiments of the invention may be placed in series along the web to perform various sequential processing steps.

For purposes of the present invention, the web is a sheet of material that has a predetermined width and thickness and an indeterminate length. The web is generally flexible to enable the insertion of the cassette across the web, thereby permitting the redirection of the web into the processing container. The web may be made of varying materials, or combinations of materials or compositions. Additionally, the web may include one or more layers of material or coatings applied onto a substrate. Non-limiting examples include polymeric films, wovens, non-wovens, foils or combinations thereof. Wovens generally include various fabrics. Non-wovens include materials, such as paper, filter media, or insulating material. Polymeric films include, for example, clear and opaque polymeric films including laminates and coated films.

In a preferred embodiment, the present invention is utilized for manufacturing or processing delicate webs. Delicate webs are generally webs that create processing issues in conventional web handling processes due to either their caliper, structure or both. The web thickness and the intricate structures within the web often adversely affect productivity and quality in conventional web handling processes. For purposes of the invention, delicate webs are generally webs having a thickness of about 25 microns or less or webs with an effective elastic modulus of 1000 MPa or less. Low effective moduli may be achieved by choice of material, web temperature, chemical processing conditions, removal of material in the form of patterned holes in the web, or combinations thereof. In a most preferred embodiment, the method of the present invention is capable of handling webs of about 12 microns or less and an elastic modulus of 700 Mpa or less.

Figure 3:
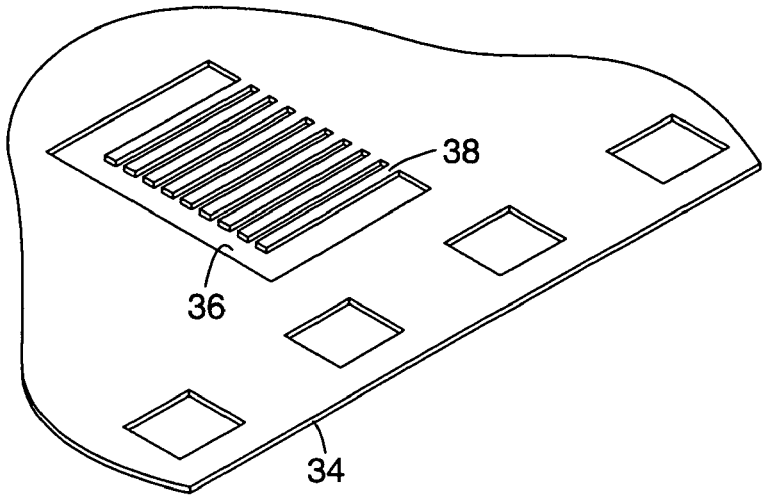
FIG. 3 is a broken sectional view of a cantilevered feature on a web.

The webs may also include cantilevered structures. Cantilevered web structures are formed by the removal of web material at predetermined locations on the web. The removal of web material leaves a free standing feature, typically within a hole or void in the web, connected by only one end to the body of the web. The cantilevered structure preferably has a total width of 100 microns or less and a length to width aspect ratio of at least 2 to 1. FIG. 3 is an illustration of a cantilevered structure on a web. Web 34 includes a plurality of voids 36 which define free standing cantilevered features 38.

As the following description will indicate, the unique conveying mechanism and the web processing techniques of the present invention improve web, and delicate web, handling practices and eliminate production and quality concerns associated with conventional web processing practices.

Figure 1:
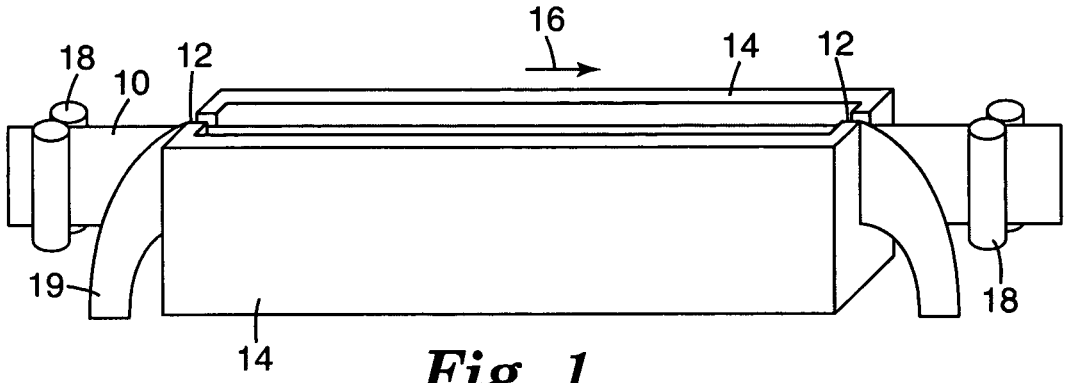
Fig. 1 PRIOR ART
FIG. 1 is an isometric view of a conventional web handling process.

The web is conveyed through the apparatus of the present invention in a substantially horizontal web path. In general terms, a substantially horizontal web path is one in which the width of the web is essentially parallel to the ground. More specifically, the web, when viewed from corresponding cross-web edges, is primarily traveling in a horizontal plane as it is conveyed through the process. A substantially horizontal web path is contrary to some conventional processing practices, such as the vertical plating process generally shown and previously described in FIG. 1. The horizontal web path provides certain advantages over conventional processes using vertical web paths. For example, the horizontal web path has an order of magnitude lower tension requirement than the vertical path and a stress state that is uniformly distributed in the cross-web direction. Greater levels of tension and stress non-uniformity on the web during processing may adversely affect finished web quality.

The processing container is generally utilized as a vessel for holding or capturing processing fluids or materials used for various conventional techniques. Typically, the container will function as a fluid bath. However, the function of the container may vary depending upon the selected processing techniques desired for a given application. Those skilled in the art are capable of selecting appropriate materials of construction and container dimensions to meet the processing demands for specific applications.

In a preferred embodiment, the container may be designed in a modular fashion to enable multiple uses for varying processes. Additionally, the container may be replicated and placed in close proximity to other containers to provide a series of multiple step processing stations. For example, a system may include two or more processing containers placed next to each other with each vessel serving as a metal plating station for multiple plating processes.

Figure 4:
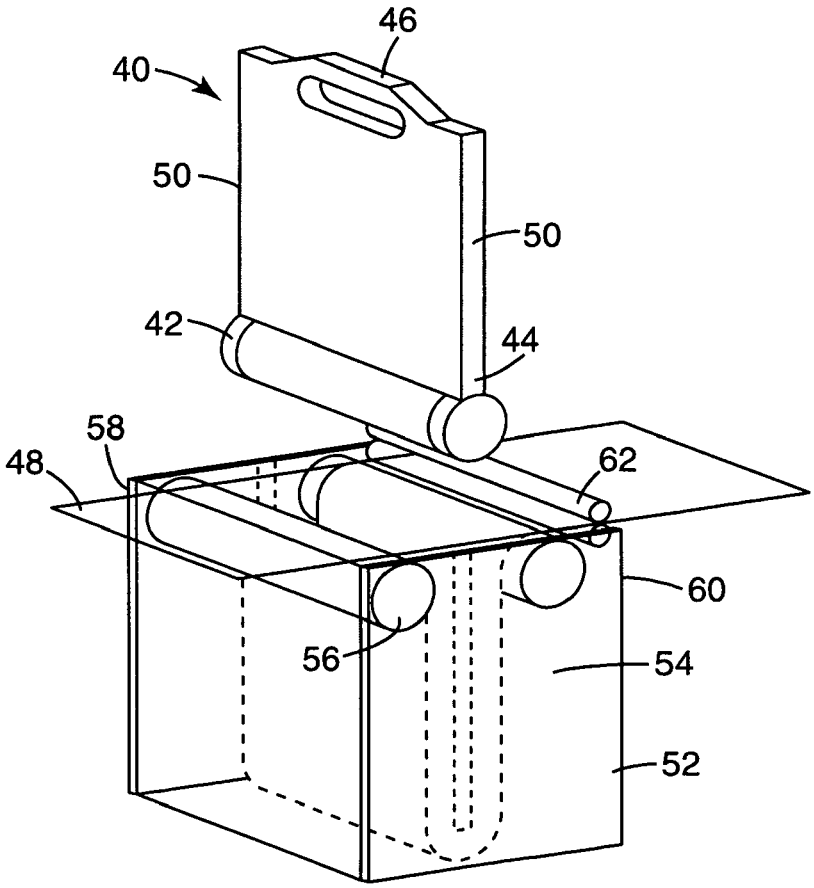
FIG. 4 is an isometric view of one embodiment of a cassette used in the present invention.

The cassette may be utilized to provide functional fluid supply and process management functions. To initiate processing of the web in the processing container, the cassette is generally inserted downward across the web and into the processing container. The use of the moveable cassettes improves the efficiency of the web threading process and reduces an individual's exposure to the compounds and solutions often utilized in wet chemistry processes. A cassette is generally depicted in FIG. 4. The cassette 40 includes at least one functional fluid element 42. The functional fluid element 42 may be located at various positions on the cassette 40. In FIG. 4, the functional fluid element 42 is located at the lower edge 44 of cassette 40. The cassette includes a handle 46 to assist in the insertion of the cassette 40 across the web 48 and onto the processing container 52. Side edges 50 are generally aligned with channels 54 that assist in maintaining the cassette 40 in a fixed position in the processing container 52. The embodiment depicted in FIG. 4 also includes functional fluid elements 56 at the leading edge 58 and back edge 60 of the processing container 52 to assist in guiding the web 48 into the processing container 52 upon insertion of the cassette 40. Additionally, the embodiment of FIG. 4 includes an optional set of air knives 62 at the back edge 60 of the processing container 52 to assist in removing fluid from the surface of the web 48.

The method and apparatus of the present invention may often utilize processing fluids that are introduced to the web through the functional fluid element. Thus it becomes necessary to provide a fluid delivery system to the functional fluid element. The fluid is preferably delivered through the cassette through conventional piping systems. Most preferably, coupling connections may be provided within or near the channels of the processing container. The connectors are attached to fluid delivery system such as a pumping system external to the processing container. As the cassette is placed into a fixed position in the processing container, corresponding connectors on the cassette match up with connectors in the channel to complete the fluid delivery system. The cassette may also include an internal manifold to permit the delivery of the fluid to multiple functional fluid elements on the cassette.

At least one functional fluid element is located on the cassette. A functional fluid element may be utilized to deliver or introduce processing fluids to the web while the web is redirected into the processing container. Functional fluid elements may take various forms depending on the processing fluid desired for specific applications and webs. Preferred functional fluid elements include fluid bearings, sparging jets, nozzles, fluid foils, pressure pads, suction elements, fluid delivery openings or combinations thereof. The functional fluid elements may be used individually or with other functional fluid elements in various arrays depending upon the desired process and finished web characteristics. Additionally, the functional fluid elements may be placed on opposing sides of the web.

Preferably, functional fluid elements are utilized to control the processing characteristics or the web. For example, pressure from fluid flow from the functional fluid element may be used to control web shape and position during processing. The functional fluid elements may also prevent the contact of the web with rigid structural components of either the cassette or the processing container. This may be of particular importance with delicate webs.

A preferred embodiment of a functional fluid element is a fluid bearing. A fluid bearing is preferably utilized as a web redirecting element. Fluid bearings may be used to achieve the web direction changes that make up the festoon web path. In general, the web direction changes typically involve 90 degree or 180 degree turns. Freshly processed web surfaces can be turned on a fluid bearing turn with no contact with any solid surface.

Figure 5:
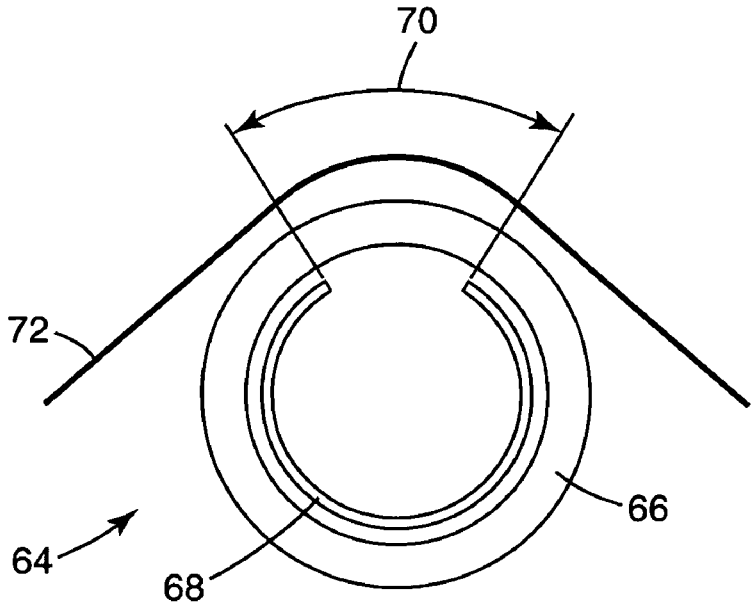
FIG. 5 is a broken sectional view of one embodiment of a fluid bearing employed in with the present invention.

FIG. 5 depicts one embodiment of a fluid bearing 64 suitable for use in the present invention. The non-rotating fluid bearing is constructed from all or a portion of a cylindrical shell 66 of a suitable porous material. Solid end caps (not shown) on the turn provide connections to the fluid supply system and also secure an internal non-porous mask 68 which determines the arc sector 70 over which fluid is allowed to pass through the porous cylindrical shell 66. The processing fluid flows from the fluid bearing and contacts the web 72. The fluid bearing is one embodiment of a functional fluid element that is attached or an integral part of the cassette. However, fluid bearings may also provide a directional turn at the leading edge or the back edge of a processing container.

Fluid bearings may also be used at various processing locations on the cassette or in the processing tank depending upon the type of processing selected for the web. For example, it may be beneficial in coating or plating applications to introduce the coating fluid at multiple points along the web path while the web is in the processing container. Fluid bearings applied at various locations on the cassette may take different forms than that described with respect to FIG. 5. Those skilled in the art are capable of selecting fluid bearings for specific webs and web processes.

Another preferred embodiment is a series of fluid bearings off-set in the down web direction on alternating sides of the web. The fluid bearings are used in a manner similar to the air support nozzles in an air floatation oven design. An alternating or staggered positioning of the fluid bearings allow accurate positioning and flattening of the web in the cross web direction. A first set of fluid bearings may be fixed to the cassette while a second set is generally fixed at in the processing container with the web interposed between the first and second set of fluid bearings when the cassette is inserted. The fluid bearings may be provided as strips and machined from a suitable porous material which is chemically compatible with the processing fluid.

Conventional web handling techniques and equipment are utilized to practice the method of the present invention. Web handling mechanisms can include one or more of a web driving device, a web guiding device, an electrical contact device, a tension sensing device or combinations thereof. The web handling mechanisms transport the web in a substantially horizontal path through the processing container. Additionally, conventional rollers are used to transport the web outside of the processing container. Those skilled in the art are capable of selecting appropriate web handling equipment for specific web applications.

In a preferred embodiment, an integrated, modular web handling assembly is provided in a single unit. The single unit can include driving, guiding, tensioning and, optionally, electrical contact to one or both sides of the web. Web guiding may be accomplished by the offset pivot or displacement method which provides accurate web positioning with minimum web stress. A conventional web edge detector is able to sense web position by means of first edge detection even in the presence of features or holes in the web. A conventional load cell equipped roller integrated into the web handling assembly senses web tension which is adjusted by a driven roller pair by feedback control. When required, the driven roller pair provides electrical contact to one or both sides of the web using slip ring electrical contacts which, because these rollers are driven, do not add additional stress to the web. The web handling assembly provides a convenient web handling path from one processing tank to another in multi-step processes. Threading of the web is handled using conventional techniques generally recognized by those skilled in the art.

Figure 6:
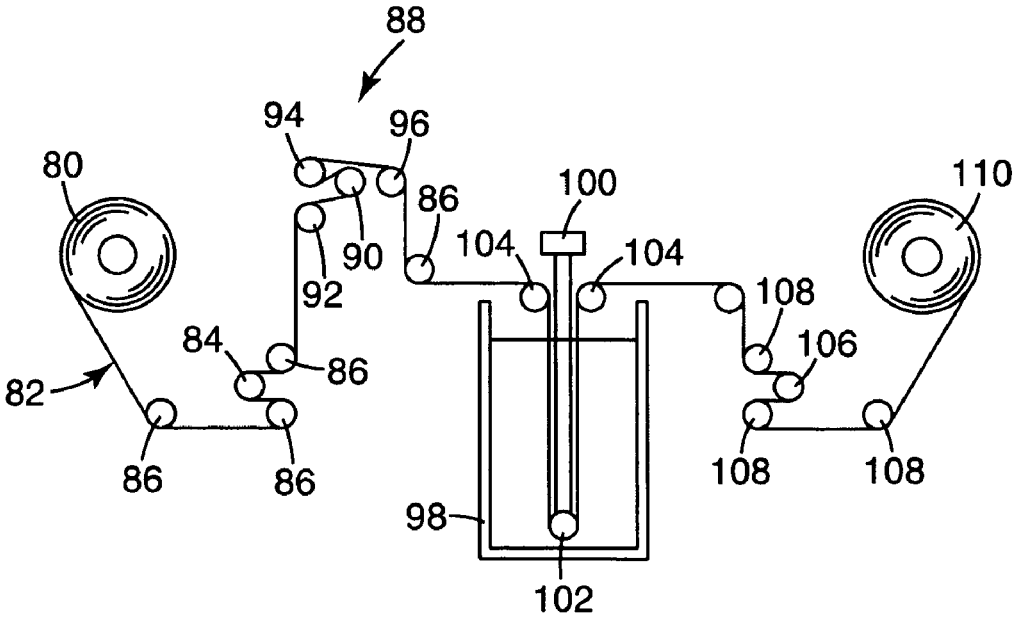
FIG. 6 is a schematic view of a web handling system used in conjunction with the present invention.

Lateral displacement of the web during processing may adversely affect the quality of the finished web. Therefore, appropriate conventional web handling mechanisms may be employed to prevent lateral drift or displacement of the web. The present invention is capable of achieving a lateral displacement of less than 0.2 cm. Low lateral displacement values are particularly desirable with specific applications such as, for example, electrodeposition processes. FIG. 6 is an illustration of a typical web conveying process employed with the apparatus and method of the present invention. A reel 80 of unprocessed web material is positioned at the forward end of the process. The web 82 is unwound from the reel 80 by incorporating dancer roll 84 with a series of idler rolls 86. A multi-functional unit 88 serves as a primary web handling unit for conveying the web 82. The multi-functional unit 88 includes a driven electrical contact roll 90, idler roll 92, driven roll 94 and a tension sensing roll 96. The tension sensing roll 96 provides feedback to control the drive rolls 90 and 94 through the use of a conventional control loop. The multi-functional unit 88 also may include active web guiding devices, passive web guiding devices or combinations thereof to assist in the prevention of lateral movement of the web 82 during processing. The web 82 is transported across a processing container 98. During operation, a cassette 100, having a functional fluid element 102 is inserted across the web 82 and into the processing container. The web 82 is then redirected into the processing container 98 forming a festoon. Additional idler rolls 104 assist in redirecting the web into the processing container 98. The web 82, upon exiting the processing container 98, is conveyed through the use of an additional dancer roll 106 and idler rolls 108. The web is then wound onto reel 110.

The present invention employs conventional web handling practices after the web has passed through the processing container. An optional air knife or other conventional fluid removal devices may be utilized to remove excess fluid from the surface of the web as it exits the processing container. Conventional winding mechanisms and idler rollers are then employed to wind the web. Those skilled in the art are capable of designing web handling layouts and selecting appropriate web handling mechanisms based on the specific web materials and the specific processing practices employed through the use of the present invention.

In operation, once the web is fed through the handling mechanisms and positioned over at least one processing container, at least one cassette is inserted into the processing container. The motion of the cassette across the web redirects the web into the processing container to form a festoon for subsequent processing of the web. The steps taken to initiate processing of the web are dependent upon the specific application. Those skilled in the art are capable of addressing start up steps during or after insertion of the cassette based on the web and the desired processing of the web. In a preferred embodiment, one or more processing containers and cassettes may be utilized in series for complete processing of the web.

For given processes, residence time in the processing vessel can be important to achieve desired results with respect to the finished web. In accordance with the present invention, the residence time of the web in the processing container may be adjusted without undue effort. The residence time may be adjusted by varying cassette length, varying cassette insertion distance, using multiple cassettes, varying fluid level height in the container or combinations thereof. Those skilled in the art are capable of determining the appropriate residence time needed, and the appropriate mechanism to achieve the residence time, based on the web and the desired finished properties of the web.

As previously noted, the characteristics and quality of the finished web are often dependent upon the tension on the web during processing. The present invention, through the utilization of a substantially horizontal web path and through the use of functional fluid elements, reduces the tension on the web during processing. Preferably, the tension on the web is less than 1000 grams total. As a result, the finished web may exhibit improved coating uniformity in coating applications. Additionally, the finished properties of the web may be enhanced due to the low web stress characteristics present during processing. For example, a tensioned web during a plating process can result in a finished web with significant curl. Web curl generally results when a stress free material is plated or applied to a tensioned substrate. Web curl is indicated by the inverse of the measured radius of a sample web material laid on its edge and having no applied web stress. A web without curl is indicated by an infinite radius for the sample web. Lower plating tensions on the web will result in dramatically reduced part curl and a reduced potential for delicate web structures to extend beyond the plane of the web and become damaged.

Lateral motion of the web during processing may also create undesirable characteristics in the finished web. The web handling practices employed by the present invention significantly reduce the lateral displacement of the web during processing which enhances the results of the finished web. Preferably, the web exhibits a lateral displacement of less than 0.2 cm within the processing container.

The web handling practices of the present invention provide lower web tensions and flatter webs during processing. This allows the manufacture of products with lower effective moduli than conventional practices permit at acceptable yields. Thus the present invention permits the manufacture of thinner webs, alternate materials, delicate webs or combinations thereof over processes previously recognized in the art. With the preferred delicate webs, the present invention is capable of maintaining an applied stress on the web below the elastic yield stress of the delicate web thereby preventing undesired deformation in the web.

Because of the reduced tension on the web, the present invention is most preferably used for electrodeposition processes. For purposes of the present invention, electrodeposition generally includes any process that applies an electrical potential to produce a coating on a substrate such as, for example, electrophoretic deposition of polymers as well as electroplating of metals. In the present invention, the processing container may be filled with an electrodeposition fluid. An anode is affixed to at least a portion of the cassette. The web serves as the cathode in the process. An electrodeposition coating is then plated onto the web upon application of an electrical charge to the web. Those skilled in the art recognize that the cassette of the present invention may include either an anode or a cathode with the web functioning as the opposite potential for the desired processing application.

Figure 7:
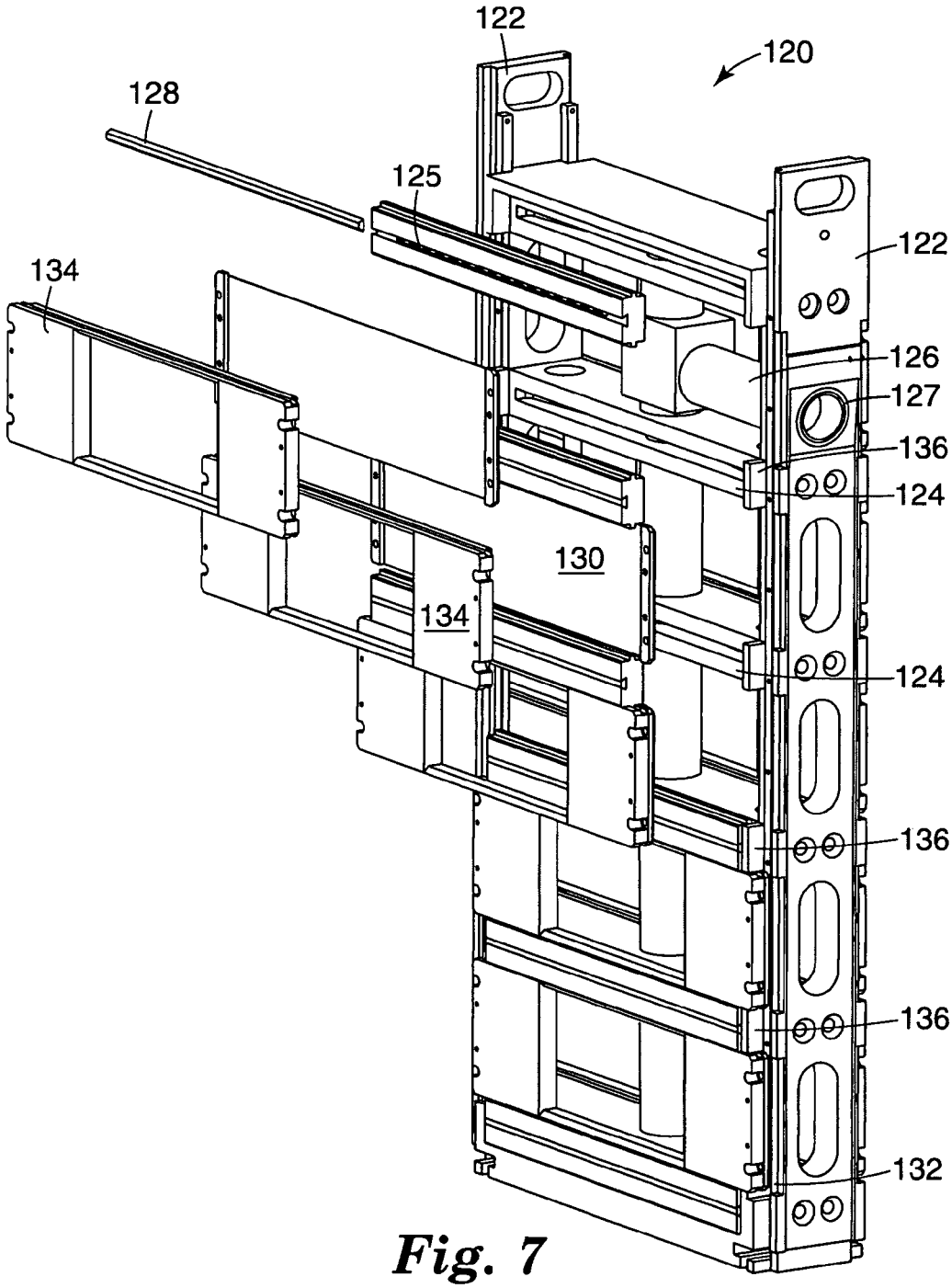
FIG. 7 is a an exploded view of a cassette suitable for use in an electrodeposition process.

FIG. 7 is an exploded view of a cassette 120 used in applying an electrodeposition coating onto a web through the use of the present invention. The cassette 120 includes side rails 122 that enable placement of the cassette 120 into a processing container. The side rails 122 provide structural support for multiple manifolds 124. Processing fluids are provided to the manifolds 124 through manifold feed pipe 126. Manifold feed pipe 126 connects to a corresponding connecting unit (not shown) located on the side of the processing container via o-ring seal 127. The manifolds supply processing fluid through manifold face plates 125 to corresponding fluid bearings 128. Anode screens 130 are positioned between the manifolds 124 and the fluid bearings 128, and between the outer edges 132 of opposing side rails 122. Optional plating masks 134 are preferably slide mounted onto the side rails 122 through the use of support brackets 136 affixed to the outer edges 132 of the side rails 122. The masks 134, positioned between a web (cathode) and the anode screen during processing, are utilized to provide a predetermined pattern of an electrodeposited coating onto the web.

In a conventional electroplating configuration, improved anode-to-cathode spacing is the one variable affecting the uniformity of plating thickness. Since anodes can be machined flat, the cross-web flatness achieved through the horizontal festoon of the present invention provides a distinct plating uniformity advantage over conventional processes. Furthermore, the functional fluid elements within the processing container enable additional uniformity benefits, especially due to the elimination of the weir flows used in conventional electrodeposition processes. The present invention is capable of achieving a coating thickness with a standard deviation, of about 4% or less when measured in either the cross web or down web direction. Conventional vertical processes generally have coating thickness with a standard deviation of greater than about 7%.

Figure 8:
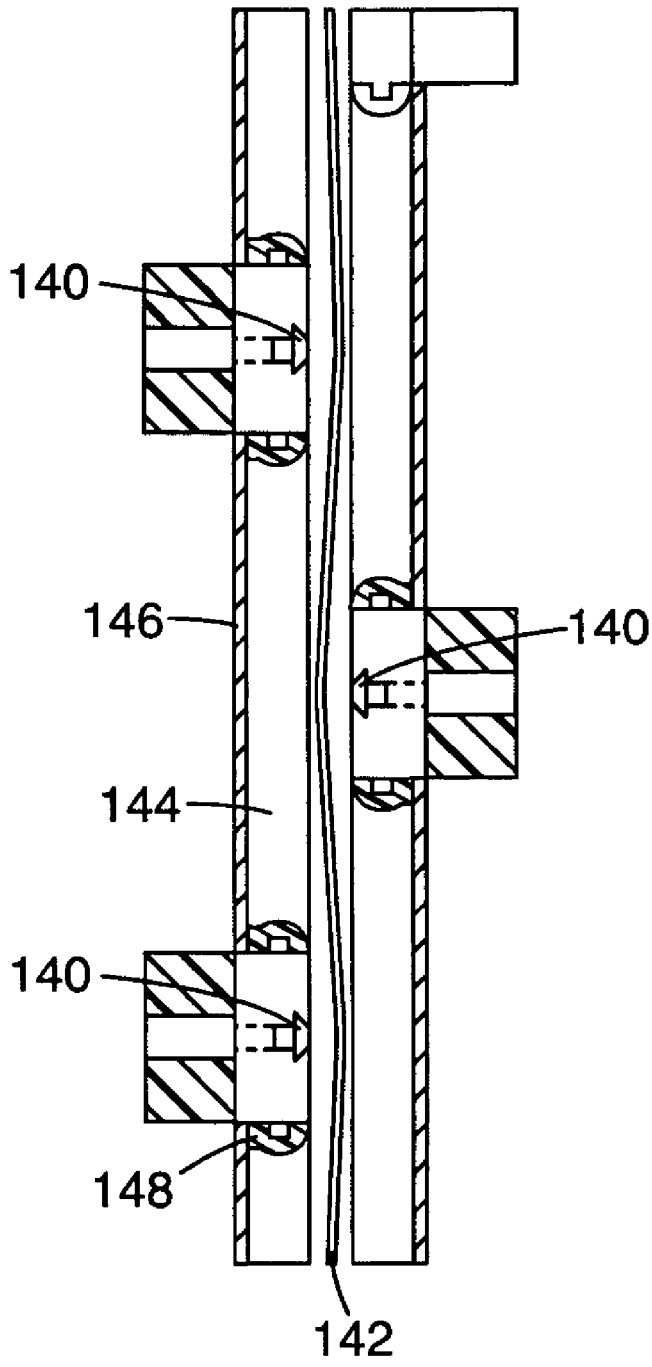
FIG. 8 is a broken sectional view demonstrating the cathode/anode relationship between the cassette and web during processing.

FIG. 8 depicts the special relationship between the web and the anode that enable improved electrodeposited coatings in conjunction with the present invention. Alternating fluid bearings 140 are located on opposing sides of web 142. An anode screen 144 is placed near the web 142. Masks 146 may also be fixed into selective locations near the web 142. In the embodiment depicted in FIG. 8, the anode screens 144 are attached to the masks 146 and held in place through the use of supports 148. The supports 148 are integrally formed in masks 146. The fluid flow from the fluid bearings 140 causes the web 142 to curve slightly in the downweb direction as it passes by each fluid bearing 140 thereby imparting cross web stiffness in the web 142. The cross web stiffness, in conjunction with the low tension on the web, enhances the ability to coat webs uniformly at low stress and thereby achieve desirable finished web characteristics.

The invention is further illustrated in the following non-limiting example.

EXAMPLE

The present example utilized a 20.3 cm (8 inch) wide web of 1 mil thick polyimide. The polyimide web was previously sputter coated with a 2 micron thick layer of copper. A web transport system was generally employed to convey the web through a processing container of nickel sulfamate (Technic High Speed Nickel Sulfamate Bath). The web transport system consisted of four sections: an unwind, pacer pull roll, tension pull roll, and winder sections. The web was threaded through the system to provide substantially horizontal path and placement of the web over the processing container. The web transport system utilized a conventional PID controller to maintain a desired tension on the web during processing.

The unwind section included an unwind spindle employing a Kollmorgen BDS4 AC servo drive with Kollmorgen brand Goldline model 203 Series motors with resolver feedback (Kollmorgen Inc, Radford, Va.). A conventional Bayside brand PG series planetary gearbox (Bayside Gearboxes Co., Port Washington, N.Y.) is connected to the unwind spindle to provide low backlash. A vertical hanging pivoting dancer system was used to regulate tension on the web between the unwind and the pacer pull roll. The dancer tension force was applied by a low friction pneumatic cylinder. A conventional rotary variable displacement transducer (RVDT) coupled to the dancer pivot detected the dancer position.

The pacer pull roll section is a composite pull roll/steering/tension sensing/anode roller. The anode roller was driven to reduce friction effects. The roll was electrically isolated from the machine via insulating plastic mounts and a plastic coupling. Litton Poly-Scientific brand model #AC4598 slip rings (Litton Poly-Scientific, Blacksburg, Va.) were used to electrically connect the roll to the power supply. A Fife brand model CDP-01-M steering guide (Fife Corp., Oklahoma City, Okla.), with stainless steel mechanical components for corrosion resistance was used for web steering. The guide was implemented in an offset pivot guide configuration. Conventional ultrasonic or optical web edge sensors were employed for web positioning sensing. The drive system consisted of a Kollmorgen model Servostar SC amplifier, with Kollmorgen XT series servo AC brushless servo-motors, with encoder feedback. Micron brand model number AT10 series (Micron gearboxes, a division of Thomson Industries, Inc., Port Washington, N.Y.) straight through low backlash gearboxes were employed. Tension sensing was accomplished via two BLH brand LTT-020 tension transducers (BLH Electronics Co., Canton, Mass.), with a low drag roller mounted between the transducers. A BLH brand model Baldwin 2010 tension amplifier with model 308A summing junction was used for signal conditioning. This section functioned as the line pacer, and the tension signal was used for monitoring only.

The web was inserted into the process container by inserting a cassette, similar to that disclosed in FIG. 7, across the web and into the processing container to create a festoon. The cassette included an anode screen and fluid bearings as previously shown and described in relation to FIG. 7. A fluid delivery system, coupled to the cassette by conventional piping mechanisms, was initiated upon secured placement of the cassette into the processing container. The total length of web in the processing solution was about 0.92 meters. Since only one side of the cassette anode was electrified, the effective plating length of the web was about 0.46 meters. The fluid delivery system circulated the nickel sulfamate solution at 48° C. through the fluid bearing at a rate of about 256 liters per minute (64 gpm) or approximately 5.3 liters per square centimeter (3 gpm per square inch) of fluid bearing surface. The web was charged at a current of 430 amps per square meter (40 ASF) in order to plate the nickel from the nickel sulfamate solution onto the web. The web was conveyed at a speed of 0.15 meters per minute and a tension of about 0.9 Newtons per cm. The resulting effective residence time of the web in the processing solution was about 3 minutes.

Upon exiting the processing container, the web was rinsed with distilled water. An air knife was utilized to assist in the removal of process solution from the surface of the web after plating and another was used to remove excess water after rinsing. The web then passed through another composite pull roll/steering/anode roller to allow tension isolation between the plating process and winding process, as well as steering and electrification.

The resulting nickel plated web passed through a second dancer and was collected at a winder spindle which was essentially identical to the unwind section.

The resulting nickel plated web had a nickel coating thickness of about 2.2 microns. The cross-web thickness standard deviation was about 1.9% and the cross-web thickness range was about 5%.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. An apparatus comprising, (a) a substantially horizontal web path for directing a web, (b) at least one processing container, and (c) at least one cassette having at least one functional fluid element affixed thereto, wherein upon downward movement of said at least one cassette across said web path redirects said web into said processing container creating at least one festoon.

2. An apparatus according to claim 1, wherein said apparatus is utilized for electroless plating, electrodeposition, delaminating, stripping, swelling, developing, saturating, washing, cleaning, rinsing, etching, chemical milling, coating, solvent deposition, fuming, sparging or combinations thereof.

3. An apparatus according to claim 1, further comprising a web handling mechanism.

4. An apparatus according to claim 3, wherein said web handling mechanism includes one or more of a web driving device, a web guiding device, an electrical contact device, a tension sensing device or combinations thereof.

5. An apparatus according to claim 3, further comprising an offset pivot guide having a driven electrical contact roller.

6. An apparatus according to claim 1, wherein at least one functional fluid element includes fluid bearings, sparging jets, nozzles, fluid foils, pressure pads, suction elements, fluid delivery openings or combinations thereof.

7. An apparatus according to claim 1, wherein said at least one functional fluid element and pressure from fluid flow are used to control web shape and position.

8. An apparatus according to claim 1, wherein two or more functional fluid elements are placed on opposing sides of said web.

9. An apparatus according to claim 1, wherein said cassette, upon insertion into said processing container, is connected to a fluid delivery system.

10. An apparatus according to claim 1, wherein said web is tensioned at less than 1000 grams total.

11. An apparatus according to claim 1, wherein said web exhibits a lateral displacement of less than 0.2 cm within said processing container.

12. An apparatus according to claim 1, wherein said functional fluid element prevents the contact of said web with rigid structural components of either said cassette or said processing container.

13. An apparatus according to claim 1, wherein residence time of said web in said processing container is adjusted by varying cassette length, varying cassette insertion distance, using multiple cassettes, varying fluid level height in the container or combinations thereof.

14. An apparatus according to claim 1, wherein said apparatus includes two or more processing containers, and at least one cassette having a functional fluid element in each of said processing containers.

15. An apparatus according to claim 1, wherein said at least one cassette includes a fluid bearing as a web redirecting element on said cassette.

16. An apparatus according to claim 1, wherein said web is a delicate web material or a web containing delicate cantilevered structures.

17. An apparatus according to claim 16, wherein the applied stress to the web is maintained below one tenth the elastic yield stress for the delicate web.

18. An apparatus according to claim 1, wherein said cassette further comprises side edges that are generally aligned with channels in said processing container to assist in maintaining said cassette in a fixed position in said processing container during processing of the web.

19. An apparatus comprising, (a) a substantially horizontal web path for directing a web, at least a portion of said web suitable for receiving an electrodeposited coating, (b) an electrical contact device for applying a charge to said web, (c) at least one processing container containing an electrodeposition solution, and (d) at least one moveable cassette having at least one functional fluid element affixed thereto, wherein upon downward movement of said at least one cassette across said web path redirects the said web into said processing container creating at least one festoon, wherein an application of a charge to said web results in an electrodeposited coating on said web.

20. An apparatus according to claim 19, wherein said electrodeposited coating has a standard deviation of coating thickness of about 4% or less.

21. An apparatus according to claim 19, further comprising a web handling mechanism.

22. An apparatus according to claim 21, wherein said web handling mechanism includes one or more of a web driving device, a web guiding device, an electrical contact device, a tension sensing device or combinations thereof.

23. An apparatus according to claim 21, further comprising an offset pivot guide having a driven electrical contact roller.

24. An apparatus according to claim 19, wherein said at least one functional fluid element includes fluid bearings, sparging jets, nozzles, fluid foils, pressure pads, suction elements, fluid delivery openings or combinations thereof.

25. An apparatus according to claim 19, wherein said at least one functional fluid element and pressure from fluid flow are used to control web shape and position.

26. An apparatus according to claim 19, wherein two or more functional fluid elements are placed on opposing sides of said web.

27. An apparatus according to claim 19, wherein said cassette, upon insertion into said processing container, is connected to a fluid delivery system.

28. An apparatus according to claim 19, wherein said web is tensioned at less than 1000 grams total.

29. An apparatus according to claim 19, wherein said web exhibits a lateral displacement of less than 0.2 cm within said processing container.

30. An apparatus according to claim 19, wherein said functional fluid element prevents the contact of said web with rigid structural components of either said cassette or said processing container.

31. An apparatus according to claim 19, wherein residence time of said web in said processing container is adjusted by varying cassette length, varying cassette insertion distance, using multiple cassettes, varying fluid level height in the container or combinations thereof.

32. An apparatus according to claim 19, wherein said apparatus includes two or more processing containers, and at least one cassette having a functional fluid element in each of said processing containers.

33. An apparatus according to claim 19, wherein said at least one cassette includes a fluid bearing as a web redirecting element on said cassette.

34. An apparatus according to claim 19, wherein said web is a delicate web material or a web containing delicate cantilevered structures.

35. An apparatus according to claim 34, wherein the applied stress to the web is maintained below the elastic yield stress for the delicate web.

36. An apparatus according to claim 19, wherein said at least one cassette includes either an anode or cathode and said web functions as an opposite potential.

37. An apparatus according to claim 36, wherein said at least one cassette includes at least one mask for selective deposition of said electrodeposited coating on said web.

38. An apparatus according to claim 37, wherein an anode is attached to said at least one mask.

39. A method of processing a web, comprising inserting at least one moveable cassette having at least one functional fluid element affixed thereto across a substantially horizontal web such that downward motion of said cassette redirects said web into a processing container thereby forming a festoon, and contacting said web with a processing fluid while said web is in said processing container.

40. A method according to claim 39, wherein said processing fluid flows through said functional fluid element in order to treat the web.

41. A method of processing a web comprising, (a) providing a processing container, (b) providing a web extending along a substantially horizontal web path across said processing container, (c) moving at least one cassette, having at least one functional fluid element affixed thereto, across said web path so that said at least one functional fluid element contacts said web and downward motion of said cassette redirects said web into said processing container to create at least one festoon, (d) conveying said web through the processing container along a processing path created by the festoon, and (e) contacting said web with a processing fluid while said web is in said processing container.

42. A method according to claim 41, wherein said processing container includes an electrodeposition solution and said method further comprises applying a charge to said web to produce an electrodeposited coating on said web.

43. A method according to claim 42, wherein said cassette includes either an anode or cathode and said web functions as an opposite potential.

44. A method according to claim 42, wherein the electrodeposited coating has a standard deviation of coating thickness of about 4% or less.

45. A method according to claim 41, further comprising connecting said cassette to a fluid delivery system.

46. A method according to claim 41, wherein said web is tensioned at less than 1000 grams total.

47. A method according to claim 41, wherein said web exhibits a lateral displacement of less than 0.2 cm within said processing container.

48. A method according to claim 41, wherein residence time of said web in said processing container is adjusted by varying cassette length, varying cassette insertion distance, using multiple cassettes, varying fluid level height in the container or combinations thereof.

49. A method according to claim 41, wherein said method includes two or more processing containers, and at least one cassette having a functional fluid element in each of said processing containers.

50. A method according to claim 41, wherein one cassette includes a fluid bearing as a web redirecting element on said cassette.

51. A method according to claim 41, wherein said web is a delicate web material or a web containing delicate cantilevered structures.

52. A method according to claim 51, wherein the applied stress to the web is maintained below one tenth the elastic yield stress for the delicate web.

53. A method according to claim 41, further comprising introducing processing fluid through the fractional fluid element in order to treat the web.

54. A method according to claim 53, wherein the processing fluid is utilized for one or more of electroless plating, electrodeposition, delaminating, stripping, swelling, developing, saturating, washing, cleaning, rinsing, etching, chemical milling, coating, solvent deposition, fuming, or sparging of the web.

* * * * *

UNITED STATES PATENT AND TRADEMARK OFFICE

CERTIFICATE OF CORRECTION

PATENT NO. : 6,991,717 B2 
DATED : January 31, 2006
INVENTOR(S) : King, Gregory F.

It is certified that error appears in the above-identified patent and that said Letters Patent is hereby corrected as shown below:

Column 11,
Line 45, after "one" insert -- moveable --.
Line 64, after "wherein" insert -- said --.

Column 14,
Line 52, delete "fractional" and insert -- functional --.

Signed and Sealed this

Fourth Day of April, 2006

JON W. DUDAS
*Director of the United States Patent and Trademark Office*